US007416168B1

(12) United States Patent
Callahan

(10) Patent No.: US 7,416,168 B1
(45) Date of Patent: Aug. 26, 2008

(54) PRIZE LIFT TELESCOPING ASSEMBLY

(75) Inventor: John R. Callahan, Daytona Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 565 days.

(21) Appl. No.: 11/235,703

(22) Filed: Sep. 26, 2005

(51) Int. Cl.
*B66D 1/00* (2006.01)

(52) U.S. Cl. ..... 254/266; 254/279; 343/901; 52/118; 52/121

(58) Field of Classification Search ..... 254/266, 254/276; 343/901, 903, 711, 712, 713, 714; 52/121, 111, 118
See application file for complete search history.

(56) References Cited

U.S. PATENT DOCUMENTS

| | | | | |
|---|---|---|---|---|
| 4,062,156 | A | 12/1977 | Roth | 52/111 |
| 4,181,268 | A | 1/1980 | Carolus et al. | 242/390.3 |
| 4,323,902 | A | 4/1982 | Hussey et al. | 343/903 |
| 4,580,377 | A | 4/1986 | Sundin | 52/121 |
| 4,907,007 | A * | 3/1990 | Druecker et al. | 343/715 |
| 4,913,458 | A * | 4/1990 | Hamilton | 280/6.153 |
| 5,035,094 | A | 7/1991 | Legare | 52/118 |
| 5,189,435 | A | 2/1993 | Yarsunas et al. | 343/903 |
| 5,279,084 | A | 1/1994 | Atsukawa | 52/118 |
| 5,315,795 | A | 5/1994 | Chae et al. | 52/113 |
| 5,370,334 | A * | 12/1994 | Shinkawa et al. | 242/390.2 |
| 5,414,436 | A | 5/1995 | Shinkawa et al. | 343/715 |
| 5,525,844 | A * | 6/1996 | Doolittle et al. | 307/10.1 |
| 5,557,892 | A | 9/1996 | Lavin | 52/121 |
| 5,857,648 | A * | 1/1999 | Dailey et al. | 244/172.6 |
| 6,002,378 | A | 12/1999 | Harada et al. | 343/903 |
| 6,041,558 | A | 3/2000 | Sylvestre | 52/111 |
| 6,107,969 | A | 8/2000 | Gulino et al. | 343/702 |
| 6,272,413 | B1 * | 8/2001 | Takahashi et al. | 701/50 |
| 6,299,336 | B1 | 10/2001 | Hulse | 362/526 |
| 6,494,005 | B2 | 12/2002 | Zimmerman | 52/296 |
| 6,906,684 | B2 | 6/2005 | Turner | 343/900 |

* cited by examiner

*Primary Examiner*—Emmanuel M Marcelo
(74) *Attorney, Agent, or Firm*—Standley Law Group LLP

(57) ABSTRACT

An electromechanical prize dispensing system is provided for a game used, for example, in the arcade, amusement, carnival, trailer, or group game industries. The invention includes a means of suspending and controlling the movement of prizes on an extensible and retractable telescopic lifting platform.

12 Claims, 13 Drawing Sheets

54
50
51
92
84
94
48
96
90
40
20
69
58

40
18
82
76
25
20
74
84
30
72

PRIZE LIFT TELESCOPING ASSEMBLY

TECHNICAL FIELD OF THE INVENTION

The present invention relates to the general field of games, and more particularly, a prize dispensing system for a game used in the arcade, amusement, carnival, trailer, and group game industries.

BACKGROUND AND SUMMARY OF THE INVENTION

Many games, particularly arcade, amusement, trailer, and carnival games, offer prizes to players by various means such as dispensation by chutes, tubes, and the like if game-winning criteria are achieved. In order to attract players away from competitive games, new and innovative methods of displaying and dispensing prizes to players are needed.

The present invention includes a novel method of lifting and displaying prizes by means of an electromechanical telescopic lifting device. For example a prize, placed atop the lifting device, is raised to various heights in a competing fashion relative to adjacently located lifting devices. In this example, game contestants control the vertical position of the prize by how well he or she scores in the game; the better the score, the higher the prize is elevated relative to competing game opponents. The first contestant to raise his or her prize the highest wins the game and the prize. This novel approach to prize dispensation provides an exciting way to allow contestants to both observe and compete for prizes.

In addition to the novel features and advantages mentioned above, other objects and advantages of the present invention will be readily apparent from the following descriptions of the drawings and preferred embodiments.

DETAILED DESCRIPTION OF THE INVENTION

Figure 1:
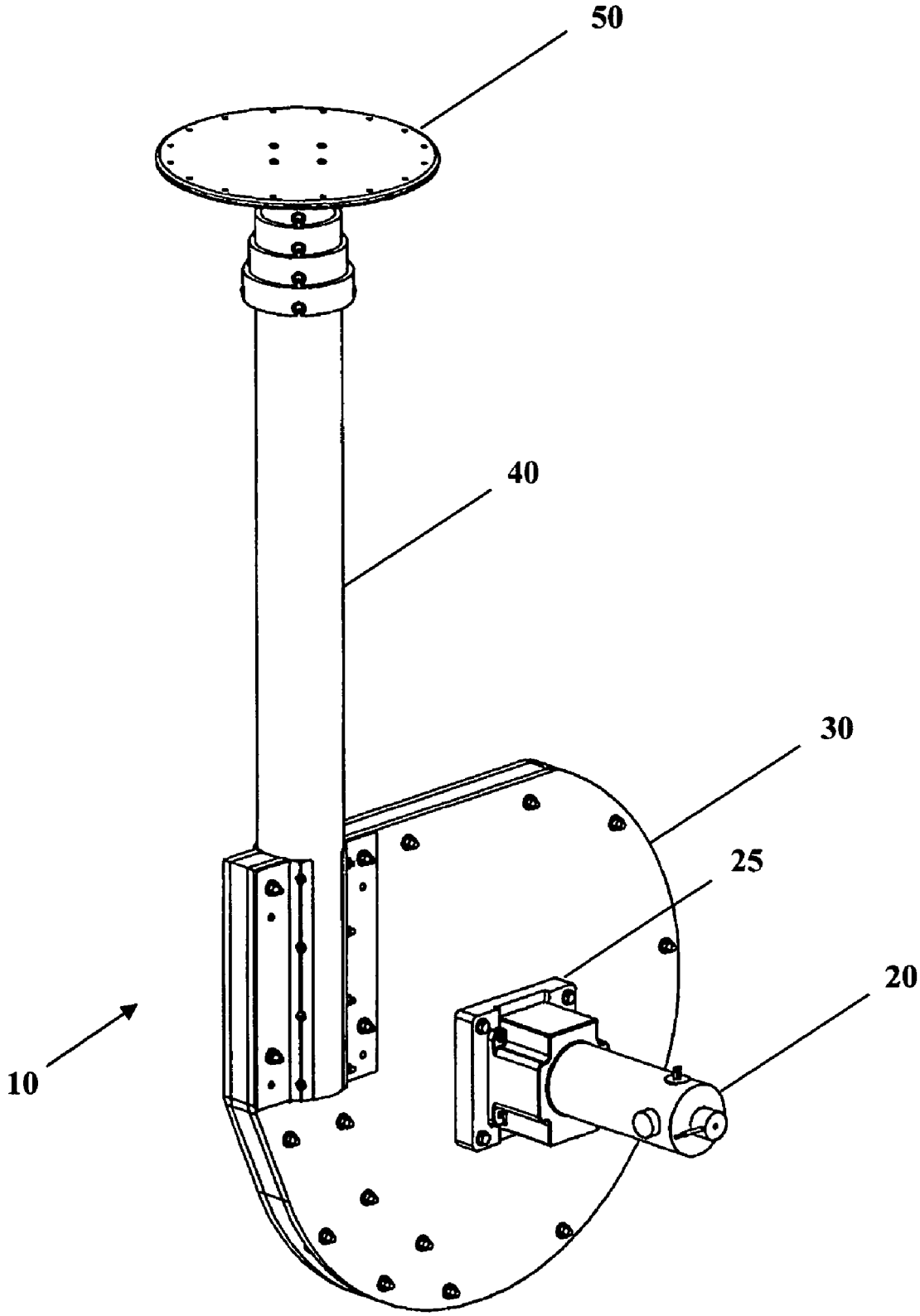
FIG. 1 is a perspective view of an example embodiment of the present invention.

FIG. 1 shows one embodiment of the present invention 10 which comprises, but is not limited to: a motor drive subassembly 20 and spacer 25, band spool subassembly 30, an exterior lift tube 40 with internally-disposed telescopic assembly of a plurality of smaller diameter lift tubes, and prize display disc 50. The motor drive subassembly 20 is controlled by a microprocessor-based electronic controller and is used to drive the prize display disc 50 vertically to specific elevations as dictated by commands from the microprocessor. The microprocessor generates commands based upon the performance of the game contestant.

Figure 2A:
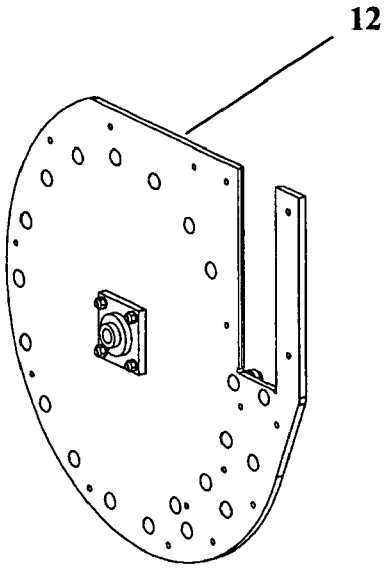
FIG. 2*a* is a pictorial view of an example embodiment of the bearing side of a band spool housing cover of the present invention.
Figure 2B:
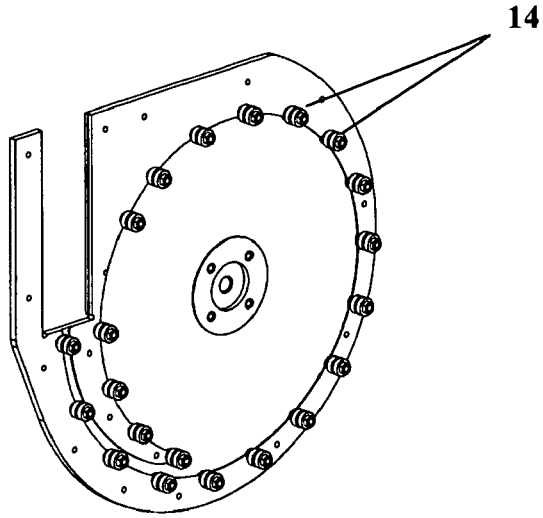
FIG. 2*b* is a pictorial view of the internal face of an example embodiment of the bearing side of a band spool housing cover of the present invention.
Figure 2C:
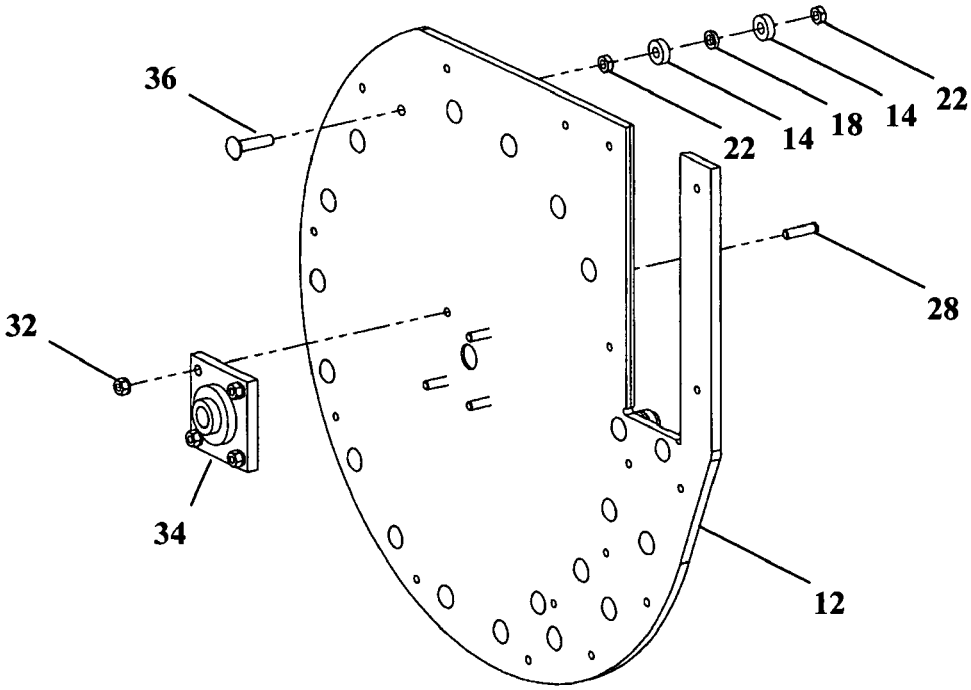
FIG. 2*c* is a pictorial exploded view of an example embodiment of the band spool housing of the present invention illustrating fastener attachment of example bearings.

FIGS. 2*a*, 2*b*, and 2*c* illustrate one portion of the internal embodiments of the band spool subassembly 30. The bearing side of the band spool subassembly cover 12 supports a rotary flange bearing 34 which is fastened thereto by means of studs or fasteners 28 and locking nuts 32. A plurality of roller bearings 14 are mounted to band spool subassembly cover 12 by means of carriage bolts or other fasteners 36, hex or other nuts 22 and spacers 18.

Figure 3A:
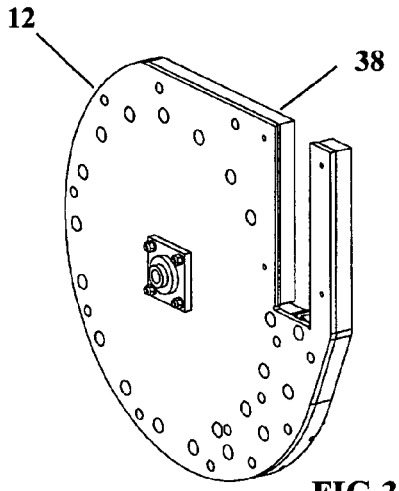
FIG. 3*a* is a pictorial view of an example embodiment of a partially assembled configuration of the bearing side of a band spool housing cover of the present invention.
Figure 3B:
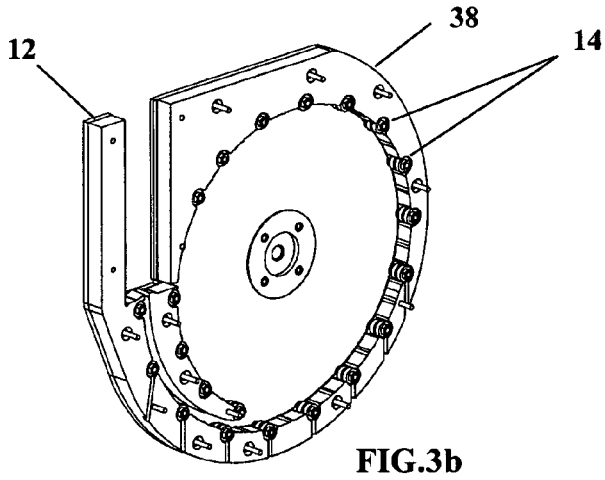
FIG. 3*b* is a pictorial view of the internal face of an example embodiment of the bearing side of a band spool housing cover of the present invention showing a detailed view of internal components.
Figure 3C:
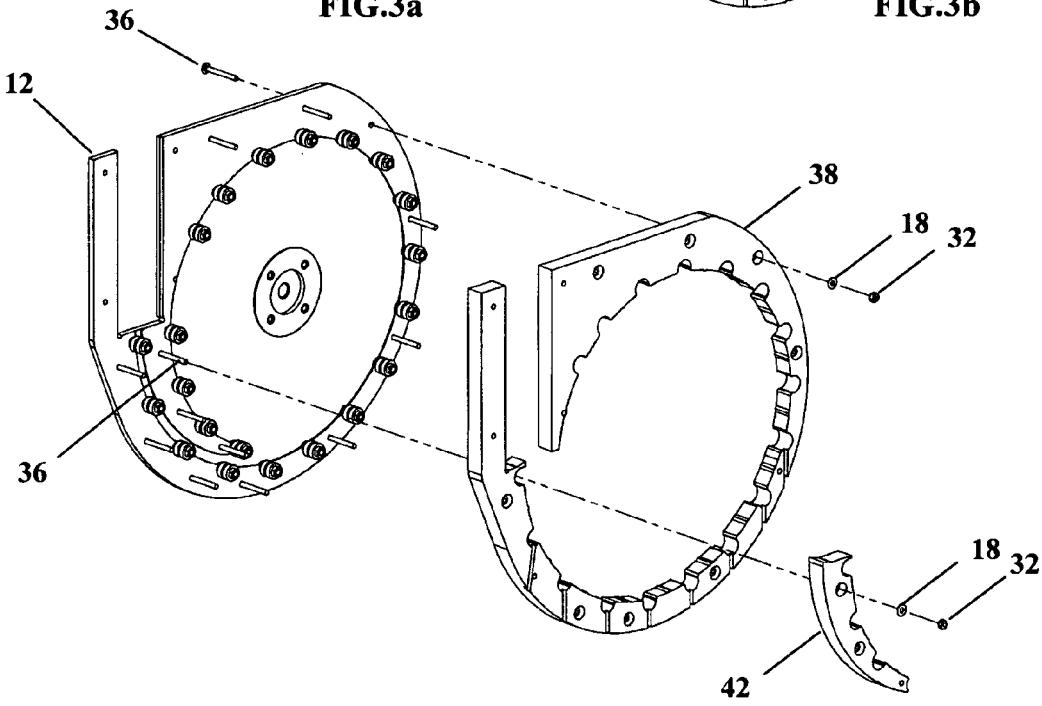
FIG. 3*c* is a pictorial exploded view of an example embodiment of the band spool housing of the present invention illustrating fastener attachment of internal components.

FIGS. 3*a*, 3*b*, and 3*c* further illustrate the internal embodiments of the band spool subassembly 30. A band spool housing 38 is mounted to the interior face of the bearing side of the band spool subassembly cover 12 by means of a plurality of carriage bolts or other fasteners 36, locking or other nuts 32 and spacers 18. A band spool housing guide 42 is separately but similarly mounted to the interior face of the bearing side of the band spool subassembly cover 12 by means of a plurality of fasteners such as carriage bolts or other fasteners 36, locking or other nuts 32, and spacers 18.

Figure 4A:
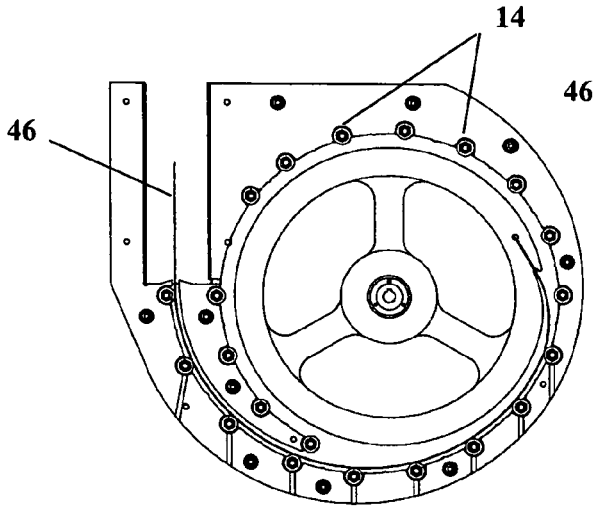
FIG. 4*a* is a plan view of the internal face of an example embodiment of an assembled configuration of the bearing side of a band spool housing cover of the present invention showing a disposed band spool and prize lift band.
Figure 4B:
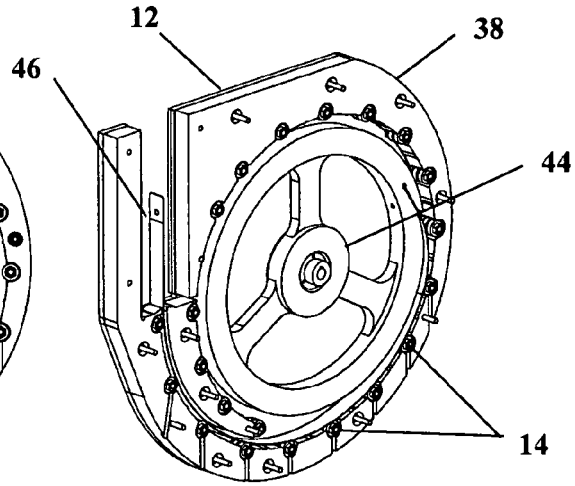
FIG. 4*b* is a pictorial view of the internal face of an example embodiment of the bearing side of a band spool housing cover of the present invention further showing a disposed band spool and prize lift band.
Figure 4C:
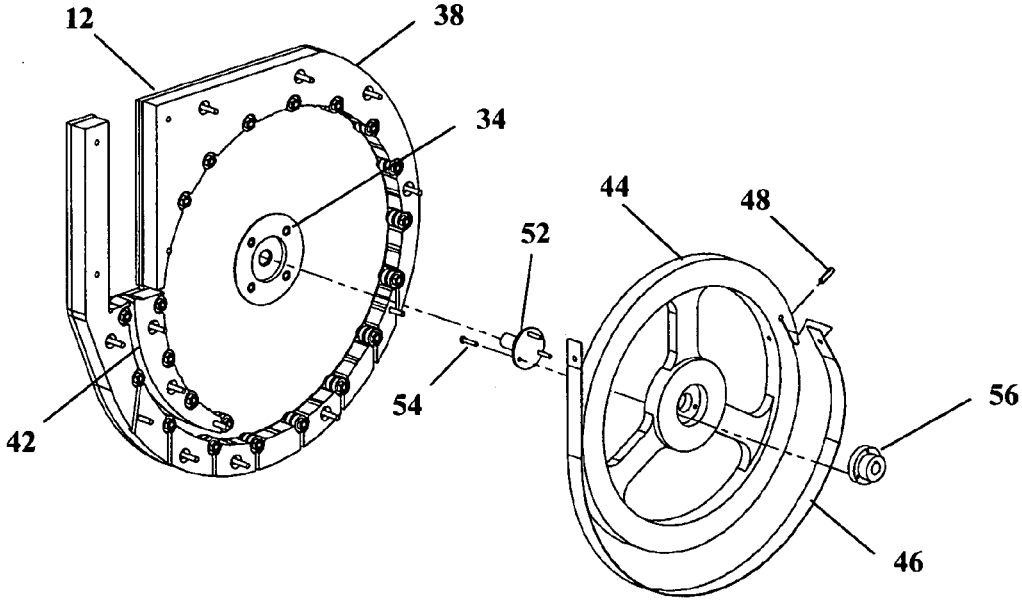
FIG. 4*c* is a pictorial exploded view of an example embodiment of the band spool cover of the present invention illustrating fastener attachment of the band spool and prize lift band internal components.

FIGS. 4*a*, 4*b*, and 4*c* further illustrate the internal embodiments of the band spool subassembly 30 wherein band spool 44 is concentrically disposed within flange bearing 34 via a flanged shaft 52. Flanged shaft 52 is retained onto band spool 44 and flanged bushing 56 by means of a plurality of button head or other fasteners 54. A flexible prize lift band 46 is peripherally disposed upon band spool 44 and retained thereto by means of a roll pin or pins 48.

Figure 5A:
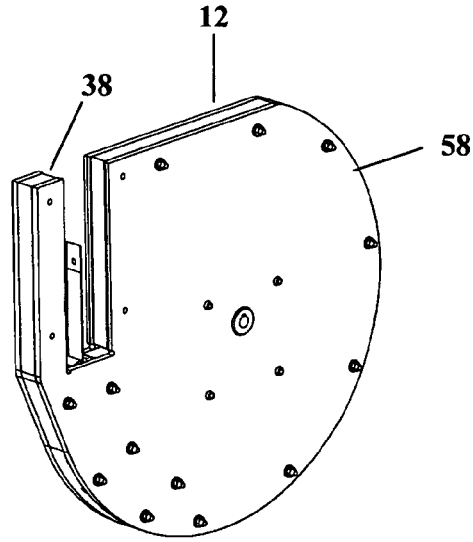
FIG. 5*a* is a pictorial view of an example embodiment of a partially assembled configuration of the motor side of a band spool housing cover of the present invention.
Figure 5B:
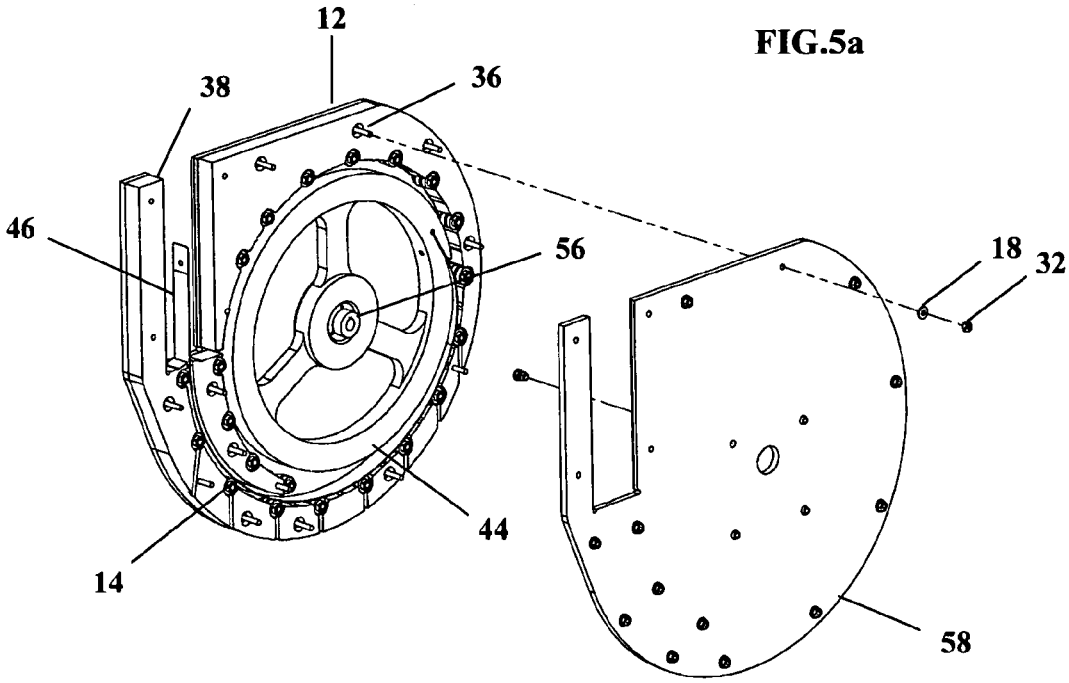
FIG. 5*b* is a pictorial exploded view of an example embodiment of the motor side band of the spool housing of the present invention illustrating fastener attachment of the band spool housing cover.

FIGS. 5*a* and 5*b* further illustrate the internal embodiments of the band spool subassembly 30 to which the motor side band spool housing cover 58 is removably attached by means of a plurality of carriage bolts or other fasteners 36, locking or other nuts 32, and spacers 18.

Figure 6A:
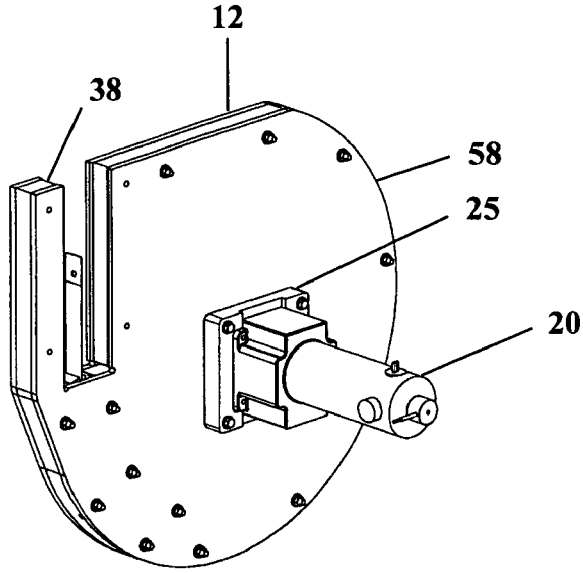
FIG. 6*a* is a pictorial view of an example embodiment of a partially assembled configuration of the motor side of a band spool housing cover of the present invention with motor subassembly.
Figure 6B:
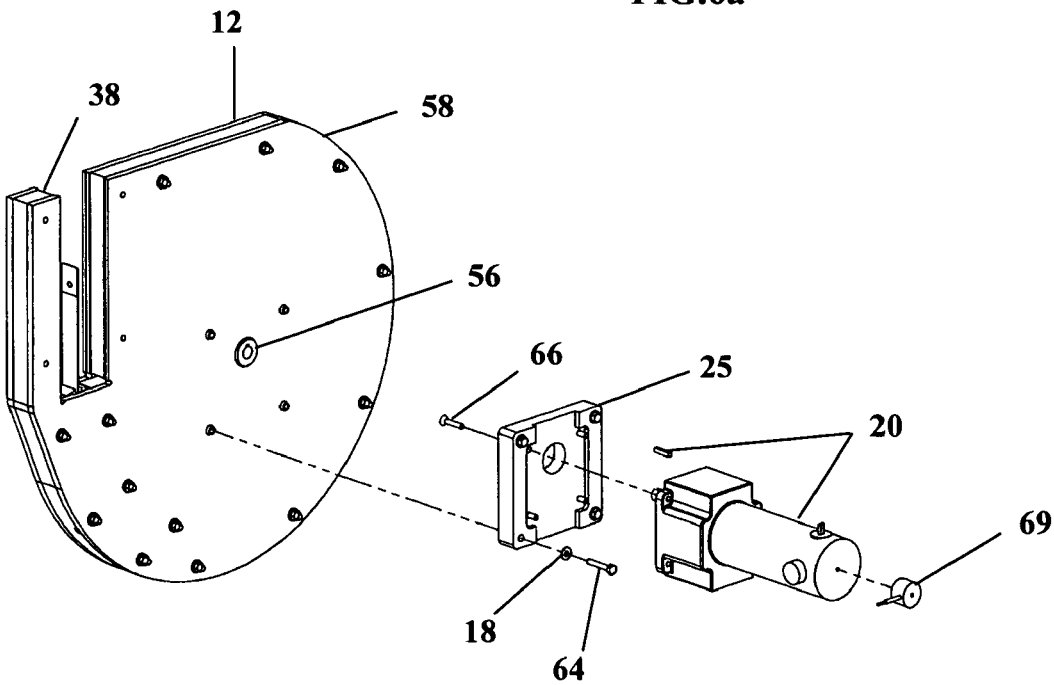
FIG. 6*b* is a pictorial exploded view of an example embodiment of the motor side band spool housing cover of the present invention illustrating fastener attachment of the motor subassembly.

FIGS. 6*a* and 6*b* further illustrate the embodiments of the band spool subassembly 30 wherein motor drive subassembly 20 is disposed upon motor spacer 25 by means of a plurality of flat head or other fasteners 66. The motor drive subassembly 20 and motor spacer are further disposed upon the motor side band spool housing cover 58 by means of a plurality of hex bolts or other fasteners 64 and spacers 18 with the shaft of the motor drive subassembly 20 concentrically engaging flange bushing 56. A positional encoder 69 removably affixed to the shaft of the motor drive subassembly 20 provides for motor shaft positional feedback to a microprocessor control unit.

Figure 7A:
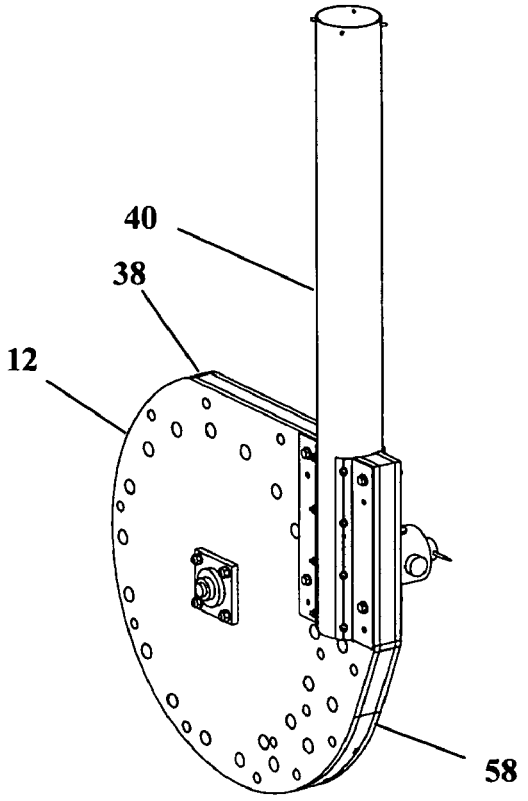
FIG. 7*a* is a pictorial view of an example embodiment of a partially assembled configuration of the bearing side of a band spool housing cover of the present invention with exterior prize lift tube subassembly disposed.
Figure 7B:
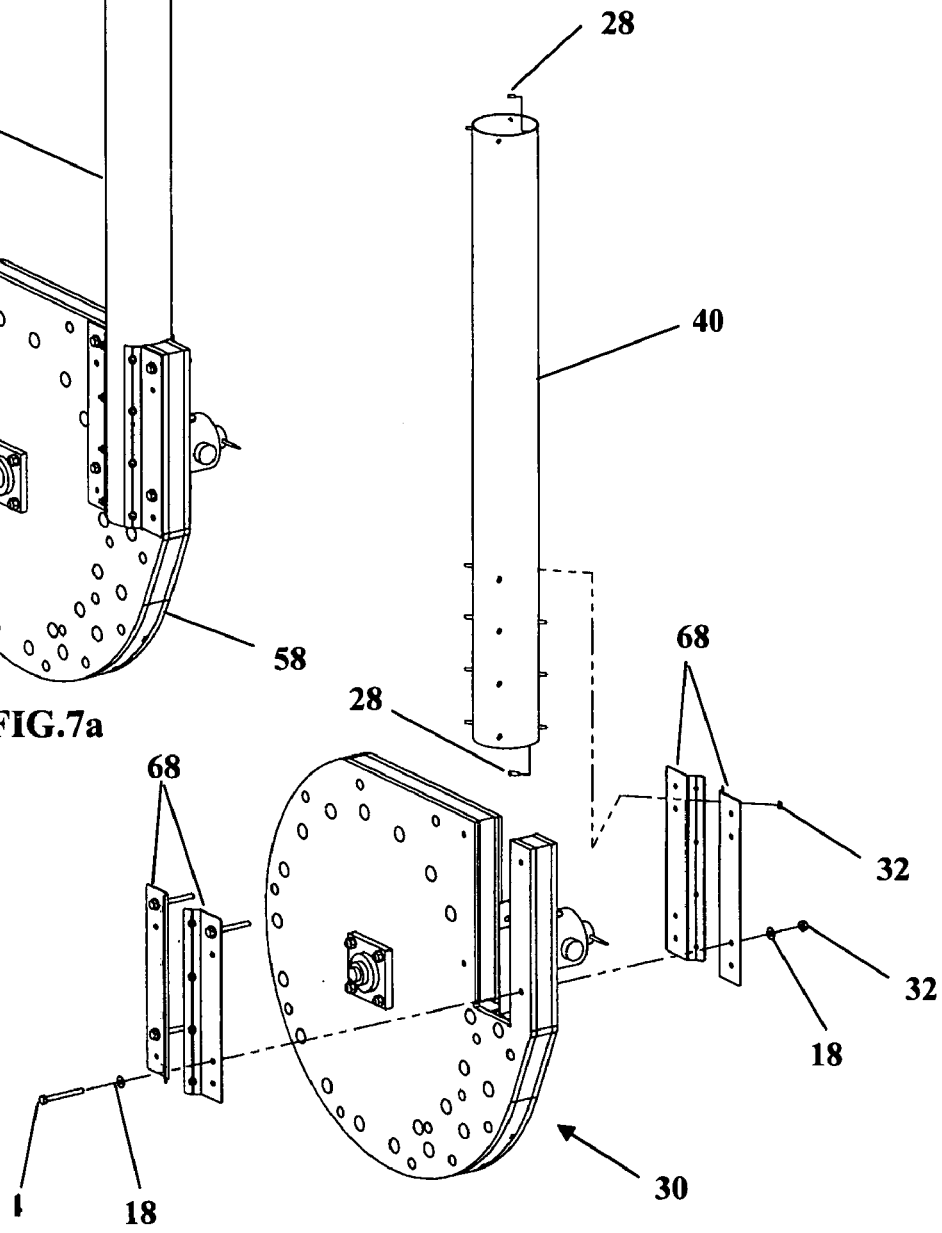
FIG. 7*b* is a pictorial exploded view of an example embodiment of the of the present invention illustrating fastener attachment of the exterior prize lift tube subassembly.
Figures 8A, 8B:
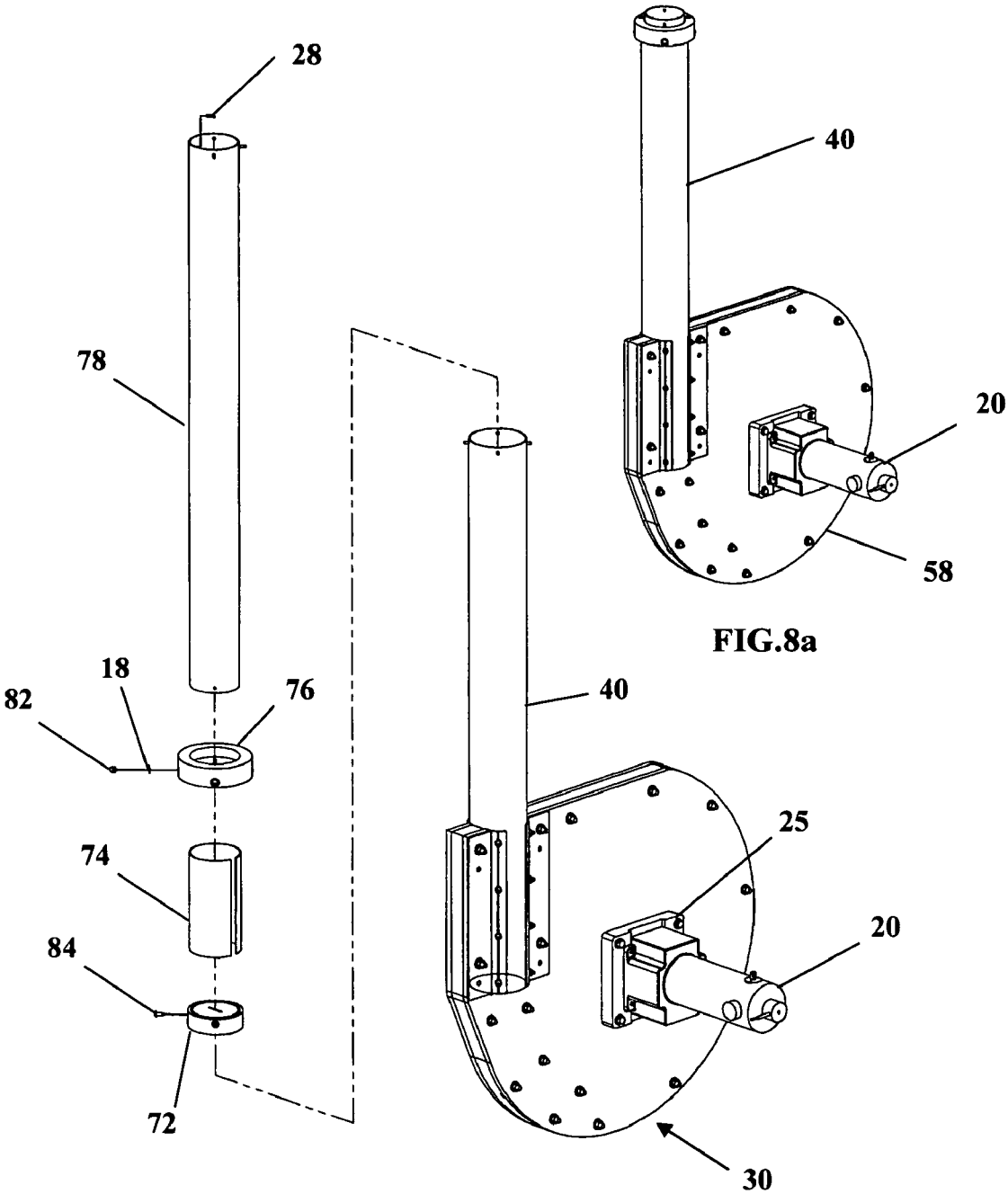
FIG. 8*a* is a pictorial view of an example embodiment of a partially assembled configuration of the motor side of a band spool housing subassembly of the present invention with a successively smaller prize lift tube disposed.
FIG. 8*b* is a pictorial exploded view of an example embodiment of the present invention illustrating assembly of a successively smaller prize lift tube of the prize lift tube subassembly.
Figures 9A, 9B:
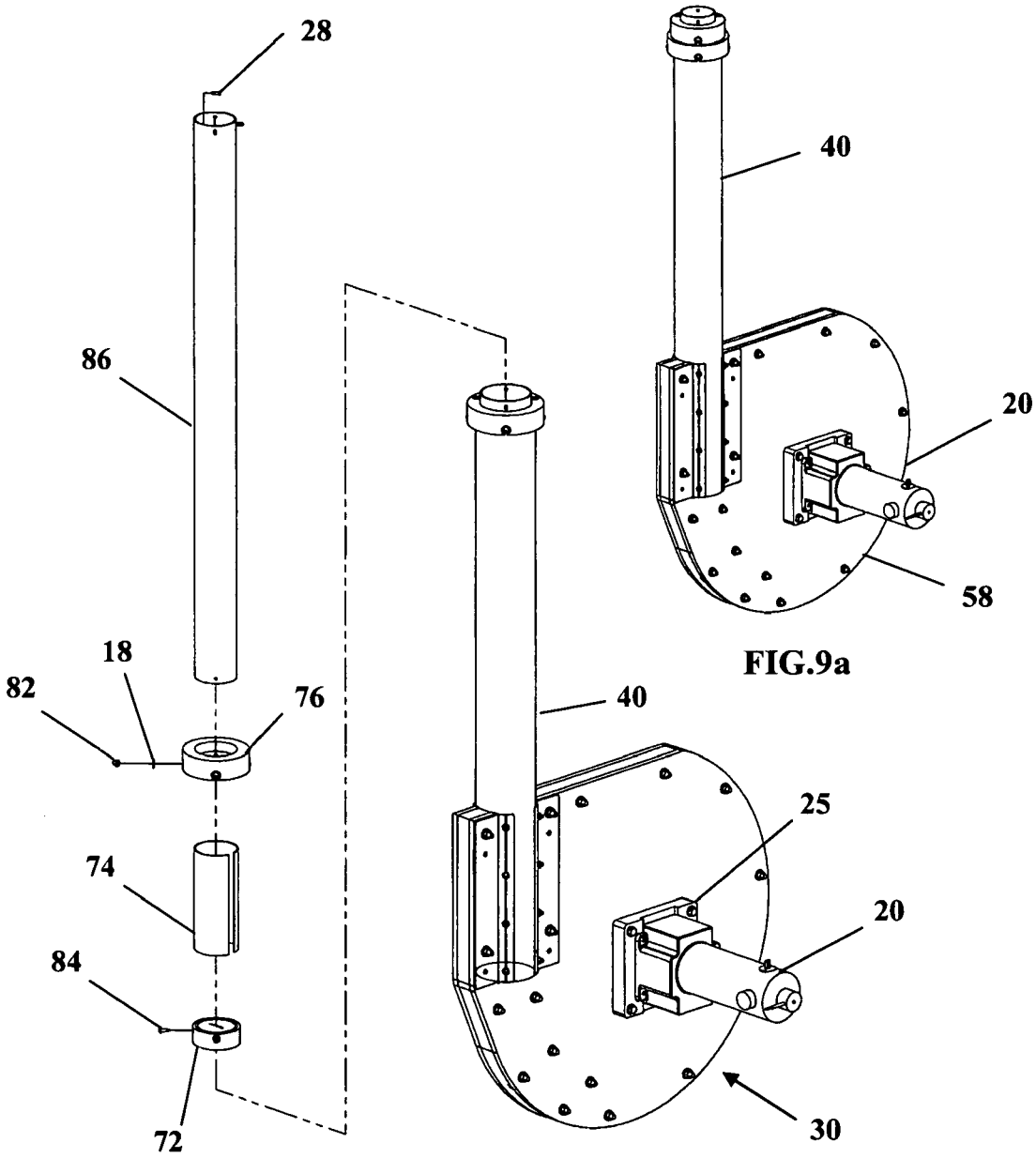
FIG. 9*a* is a pictorial view of an example embodiment of a partially assembled configuration of the motor side of a band spool housing subassembly of the present invention with a successively smaller prize lift tube disposed.
FIG. 9*b* is a pictorial exploded view of an example embodiment of the present invention illustrating assembly of a successively smaller prize lift tube of the prize lift tube subassembly.
Figures 10A, 10B:
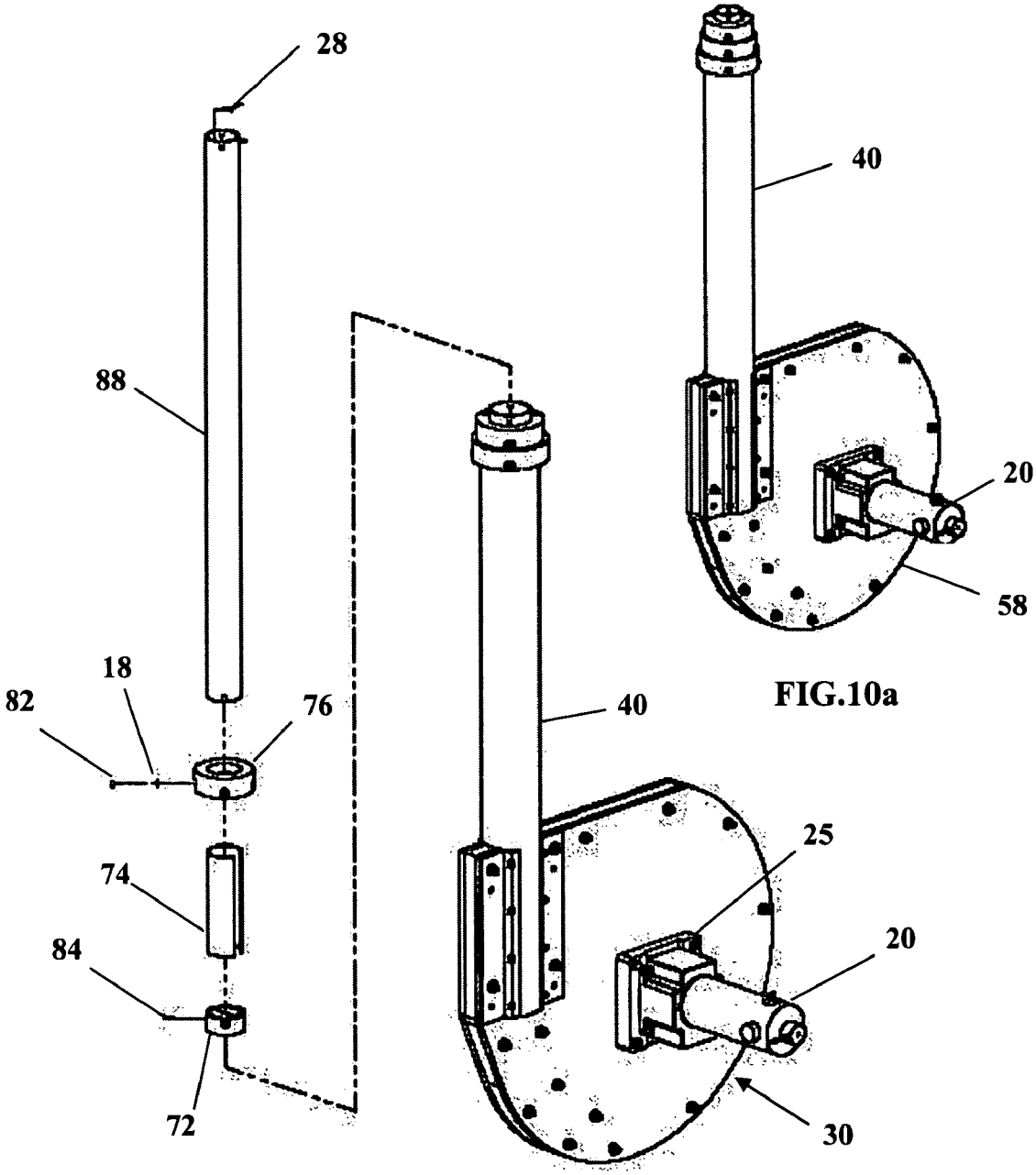
FIG. 10*a* is a pictorial view of an example embodiment of a partially assembled configuration of the motor side of a band spool housing subassembly of the present invention with a successively smaller prize lift tube disposed.
FIG. 10*b* is a pictorial exploded view of an example embodiment of the present invention illustrating assembly of a successively smaller prize lift tube of the prize lift tube subassembly.

Referring now to FIGS. 7*a* and 7*b*, an external prize lift tube-A 40 is mounted to band spool subassembly 30 by means of tube clamping brackets 68, a plurality of studs or other fasteners 28 and 64, locking nuts or other fasteners 32, and spacers 18.

FIGS. 8*a*, 8*b*, 9*a*, 9*b*, 10*a*, 10*b*, 11*a* and 11*b* illustrate the telescopically concentric dispositions of internal prize lift tube-B 78, prize lift tube-C 86, prize lift tube-D 88, and prize lift tube-E 90 within exterior prize lift tube-A 40. Prize lift tubes 78, 86, 88, and 90 are slidably fixed within the prize lift telescoping assembly 10 and exterior prize lift tube-A 40 by means of tube spacers 74, tube top bearings 76, and internal tube bearings 72, which are attached to their respective prize lift tubes by means of a plurality of spacers 18 and acorn nut or other fasteners 82 and 84.

Figures 11A, 11B:
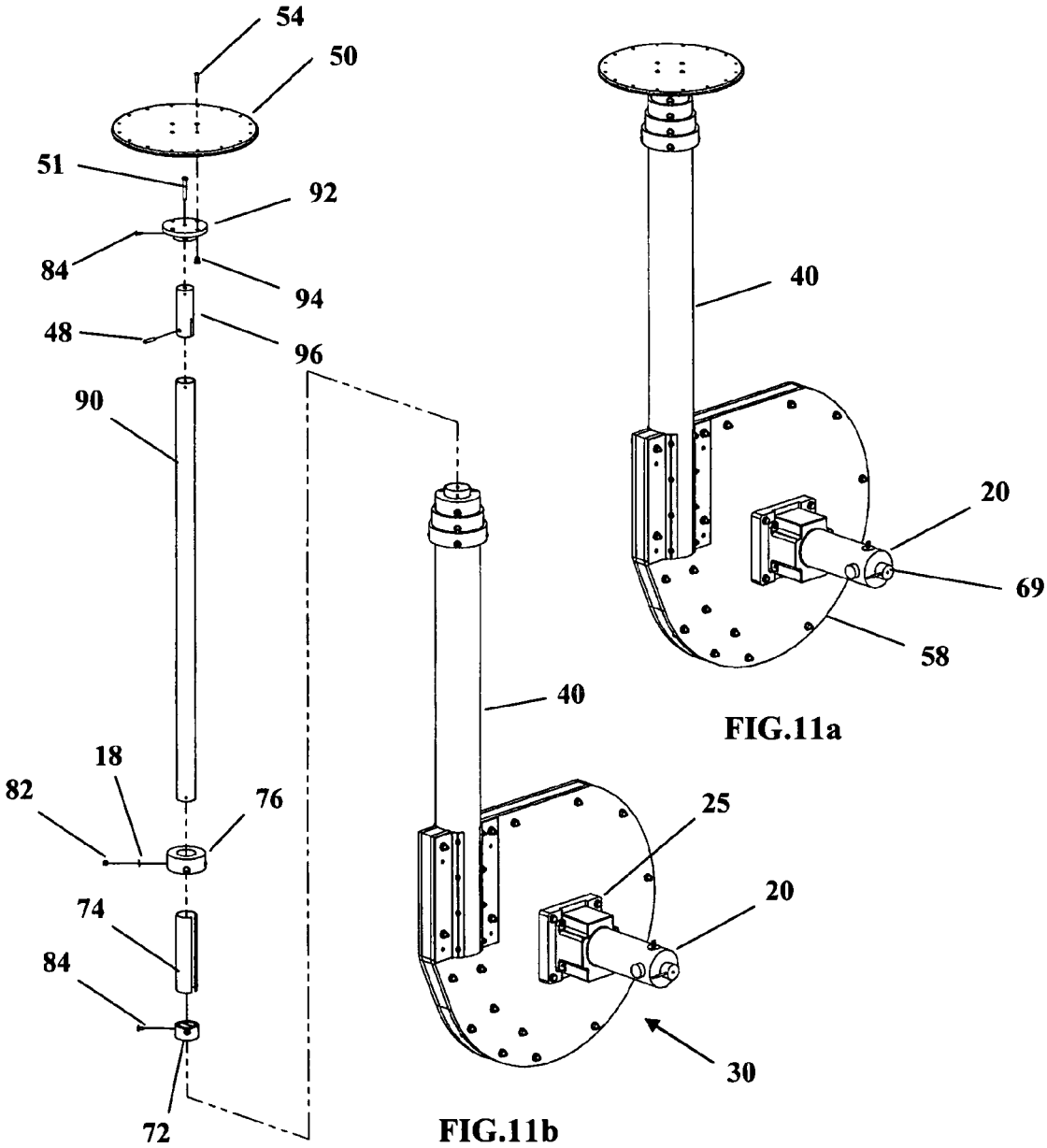
FIG. 11*a* is a pictorial view of an example embodiment of an assembled configuration of the motor side of a band spool housing subassembly of the present invention with an internal prize lift tube and prize display disc disposed.
FIG. 11*b* is a pictorial exploded view of an example embodiment of the present invention illustrating assembly of an internal prize lift tube and prize display disc of the prize lift tube subassembly.

Referring now to FIGS. 11*a* and 11*b*, prize display disc 50 is disposed onto prize display disc mount 92 by means of a plurality of button head or other fasteners 54 which are removably affixed within inserts 94 that are embodied within said display disc mount 92. Display disc mount 92 is concentrically disposed upon band clamp 96 by means a button head or other fastener 51 wherein said band clamp 96 is concentrically affixed within prize lift tube-E 90 by means of a plurality of screw or other fasteners 84. The band clamp 96 is affixed to prize lift band 46 by means of a roll pin or other fastener 48.

When in operation, the motor drive subassembly 20 of receives positional commands from a microprocessor or other control unit and is driven to a desired position relying on positional encoder 69 for positional feedback based upon the player's achievement of game-winning criteria. As shown collectively in FIGS. 4 through 11, the motor drive subassembly 20 correspondingly drives band spool 44 extending or retracting prize lift band 46 vertically within prize lift tubes 40, 78, 86, 88, and 90 wherein roller bearings 14 and band spool housing guide 42 provide support and guidance to prize lift band 46 which is respectively and peripherally unwrapped or wrapped upon band spool 44 during telescopic extension or retraction. Full retraction of the telescopic assembly may be determined by but not limited to the following examples, such as by positional feedback directly supplied by the positional encoder 69, or by sensing an overcurrent condition of the current supplied to the motor drive subassembly 20.

Figure 12:
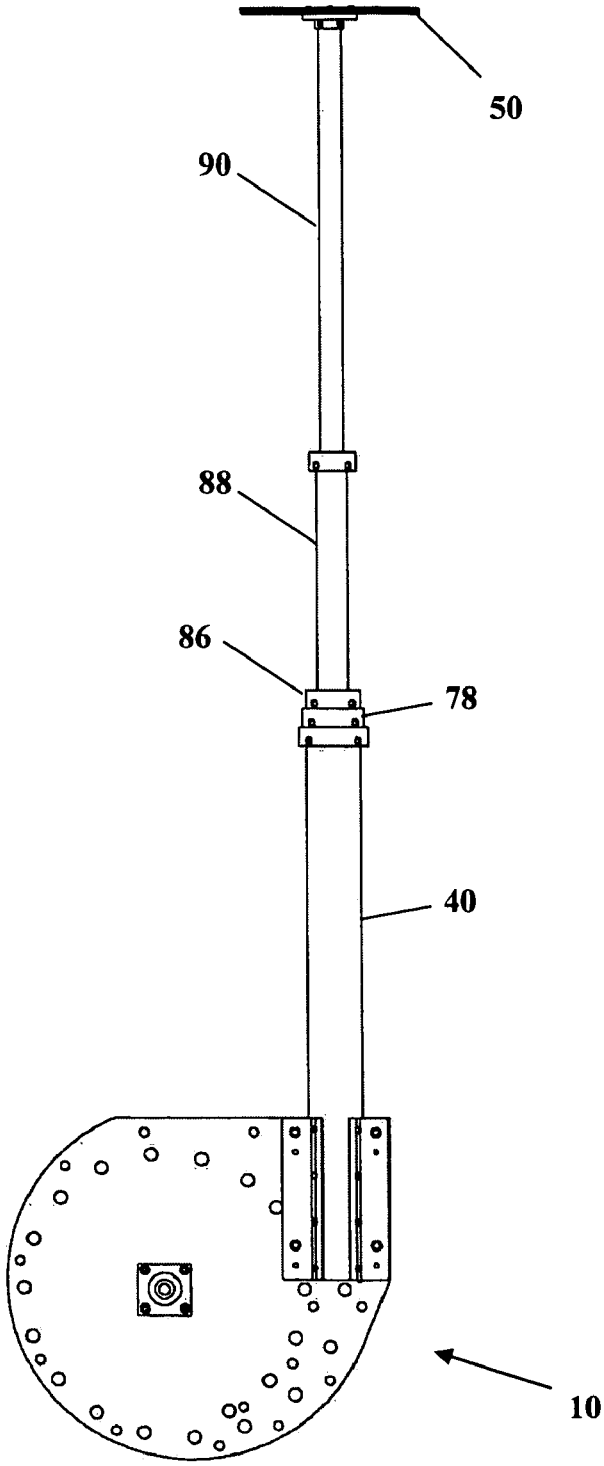
FIG. 12 is a side elevation view of an example embodiment of the present invention illustrating a partially-extended configuration.
Figure 13:
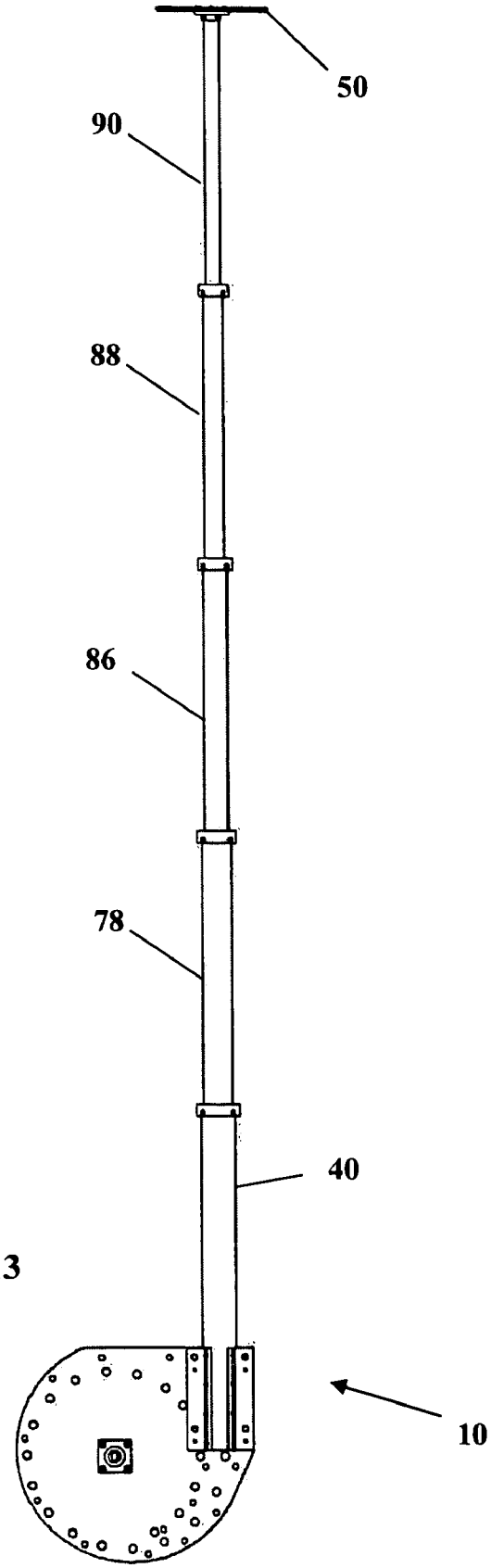
FIG. 13 is a side elevation view of an example embodiment of the present invention illustrating a fully-extended configuration.

FIGS. 12 and 13 respectively illustrate partial and full extension configurations of the invention wherein FIG. 12 illustrates the sequence of prize lift tube deployment which begins with extension of the innermost prize lift tube 90. Upon full extension of prize lift tube 90, the concentrically adjacent prize lift tube 88 is mechanically engaged by prize lift tube 90 and is correspondingly extended with subsequent engagement and extension of adjacently exterior prize lift tubes 86 and 78 until full extension of the invention is achieved as illustrated in FIG. 13. It should be noted that the number of prize lift tubes is not limited to that described herein and that more or fewer prize lift tubes may be disposed as desired.

The embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A telescopic motorized lifting device for lifting prizes and such comprising:

a prize support disc;

a band spool;

a band clamp;

a band spool housing;

a plurality of band guide support bearings;

at least two telescopic lift tubes wherein said telescopic lift tubes are concentrically disposed to allow lateral relative telescopic displacement about their longitudinal axes, each tube having an upper end and a lower end with the outermost disposed tube lower end affixed to said band spool housing and the innermost tube upper end affixed to said prize support disc;

telescopic lift tube bearings and spacers wherein said bearings and spacers are disposed on said telescopic lift tubes and said upper ends to slidably engage adjacent telescopic lift tubes and provide radial guidance to adjacent lift tubes during extension and retraction;

a prize lift band wherein said band is peripherally disposed upon said band spool with one end of said band retained thereto and the other end internally affixed to the upper end of said innermost telescopic lift tube and retained thereto by means of said band clamp;

a motor drive subassembly wherein said motor drive embodies a motor shaft that is concentrically affixed to said band spool and supported by rotational bearings to permit rotational movement of said band spool whereby when said motor drive is commanded to a desired position, said prize lift band is extended or retracted within said telescopic lift tubes thereby extending or retracting said telescopic lift tube or tubes to elevate or lower said prize support disc; and a positional encoder, wherein said encoder is disposed upon the motor shaft of said motor drive subassembly to provide positional feedback of said motor shaft.

2. The lifting device of claim 1 wherein said prize lift band is a flexible metal band of rectangular cross-section.

3. The lifting device of claim 1 wherein said prize lift band is comprised of a flexible metal of circular cross-section.

4. The lifting device of claim 1 wherein said prize lift band is comprised of a flexible plastic composite of rectangular cross-section.

5. The lifting device of claim 1 wherein said prize lift band is comprised of a flexible plastic composite of circular cross-section.

6. The lifting device of claim 1 wherein said telescopic lift tubes are comprised of metal.

7. The lifting device of claim 1 wherein said telescopic lift tubes are comprised of plastic.

8. The lifting device of claim 1 wherein said motor drive subassembly comprises an electric motor.

9. The lifting device of claim 1 wherein said motor drive subassembly comprises a hydraulic motor.

10. The lifting device of claim 1 wherein said motor drive subassembly is controlled by a microprocessor based control system wherein said positional encoder provides shaft position feedback of said motor of said motor drive subassembly.

11. The lifting device of claim 1 wherein the retracted position of the said lift tubes is determined by positional feedback derived from the said positional encoder.

12. The lifting device of claim 1 wherein the retracted position of the said lift tubes is determined by sensing an overcurrent condition of the electric current supplied to said motor drive subassembly by an overcurrent detector.

* * * * *